US005899209A

United States Patent [19]

McDonald et al.

[11] Patent Number: 5,899,209

[45] Date of Patent: May 4, 1999

[54] HAIR EXTENSION

[76] Inventors: David McDonald; Marlene McDonald, both of P.O. Box 574, Dresden, Tenn. 38225

[21] Appl. No.: 09/174,662

[22] Filed: Oct. 19, 1998

[51] Int. Cl.[6] ..... A41G 3/00; A41G 5/00

[52] U.S. Cl. ..... 132/53; 132/201

[58] Field of Search ..... 132/53, 54, 201, 132/55; 446/394, 296, 391

[56] References Cited

U.S. PATENT DOCUMENTS

| | | | |
|---|---|---|---|
| 57,328 | 8/1866 | Iverson | 132/53 |
| 59,261 | 10/1866 | Muller | 132/53 |
| 541,125 | 6/1895 | Simonson | 132/53 |
| 3,474,798 | 10/1969 | Tillotson | 132/53 |
| 3,530,862 | 9/1970 | Hudson | 132/53 |
| 4,600,029 | 7/1986 | Ueberschaar | 132/53 |
| 4,745,933 | 5/1988 | Saenger | 132/53 |

*Primary Examiner*—Gene Mancene
*Assistant Examiner*—Philogene Pedro
*Attorney, Agent, or Firm*—David L. Volk

[57] ABSTRACT

The hair extension of the present invention includes hair strands affixed to a ring assembly. The ring assembly comprises an inner ring and an outer ring. The inner ring is configured to nest within the outer ring, with distal ends of the hair strands impinged between the inner and outer rings. A plait of a user's hair is inserted through the ring assembly of the hair extension. In one embodiment, the hair extension is attached to the plait with a band, or by sewing the hair extension to the plait. In another embodiment, the ring assembly is modified with a fastening assembly for fastening the hair extension to the plait.

2 Claims, 4 Drawing Sheets

HAIR EXTENSION

BACKGROUND OF THE INVENTION

1. Field of the Invention

The present invention relates to hair supplements, particularly to hair supplements having structure which facilitates the attachment of the hair supplement to the hair.

2. Description of the Related Art

Hair extensions are commonly attached to plaited hair to achieve a new hair style. To make sure the extension is securely attached to the hair, it has heretofore been necessary to weave the wearer's actual hair to the hair extension. This tedious process takes several hours to complete, and the weaving eventually becomes undone.

What is needed is a hair extension which quickly and easily attaches to plaited hair without requiring weaving.

SUMMARY OF THE INVENTION

The hair extension of the present invention includes hair strands affixed to a ring assembly. The ring assembly comprises an inner ring and an outer ring. The inner ring is configured to nest within the outer ring, with distal ends of the hair strands impinged between the inner and outer rings.

To use the invention, a user's hair is first parted and plaited to form plaits. The plait is then inserted through the ring assembly of the hair extension. In one embodiment, the hair extension is attached to the plait with a band, or by sewing the hair extension to the plait. In another embodiment, the ring assembly is modified with a fastening means for fastening the hair extension to the plait.

Because the hair strands are attached to the ring, and the hair extension is sewn, banded or fastened to the plait, the result is a secure and long lasting hair style.

Because the plaits are inserted through the ring of the hair extension and then attached to the hair extension, the entire process of creating the hair style is much quicker than methods of the prior art.

Still further features and advantages will become apparent from the ensuing description and drawings.

DETAILED DESCRIPTION

Figure 1:
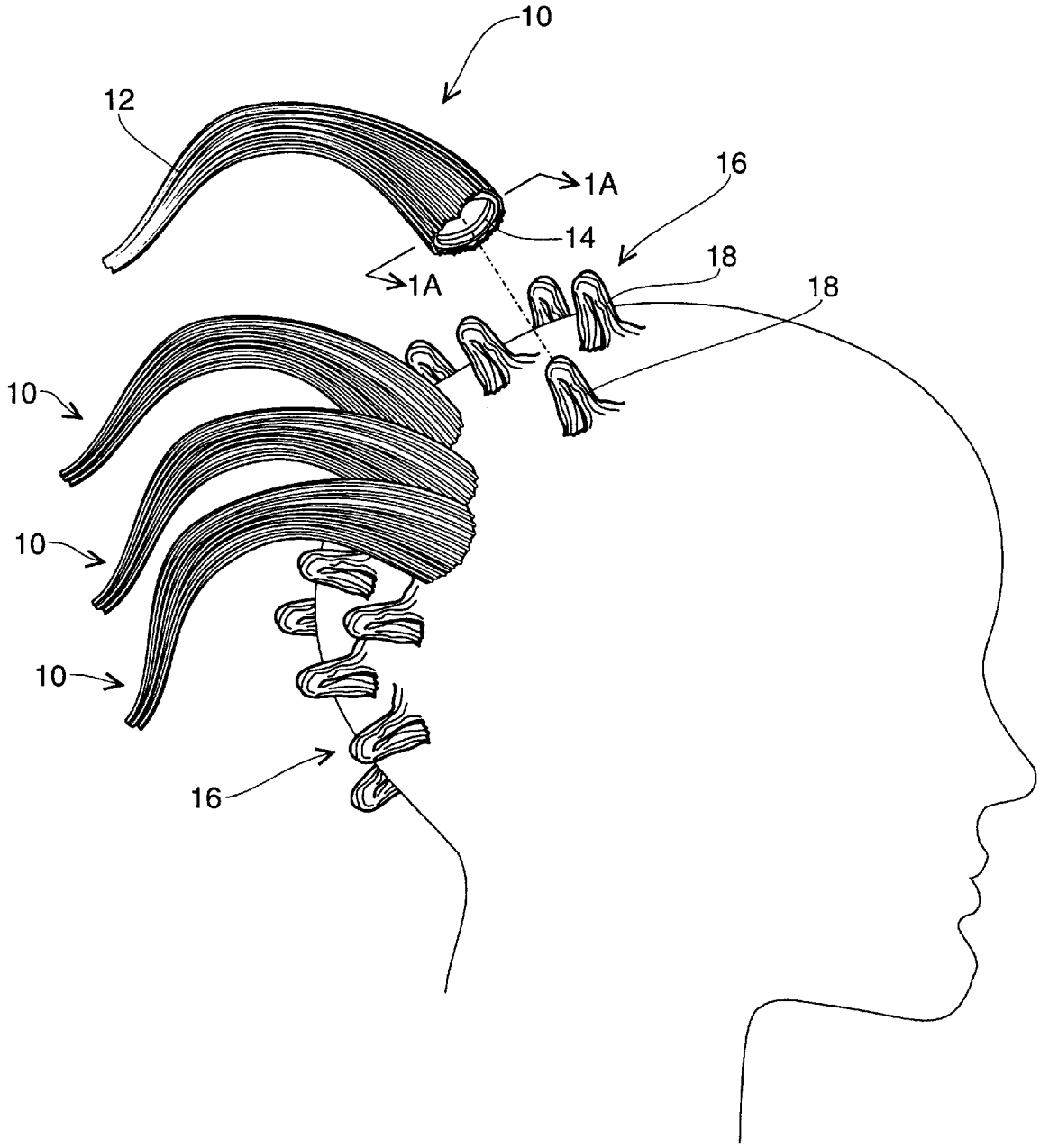
FIG. 1 is a perspective view of a hair extension of the present invention in use.
Figure 1A:
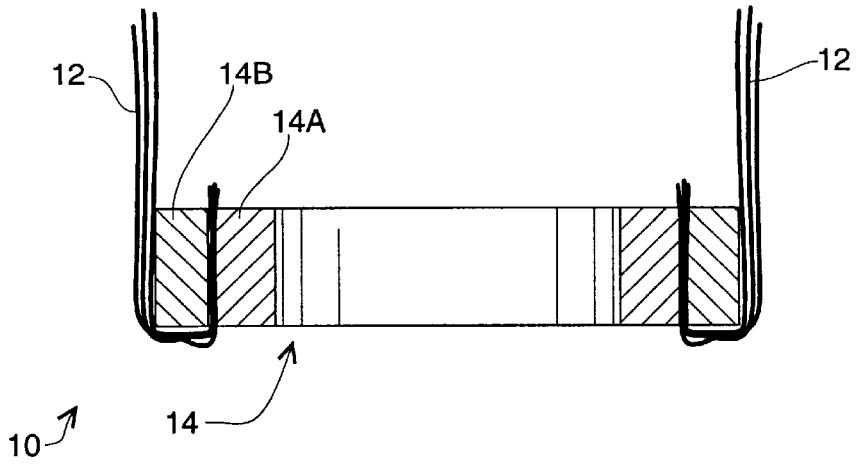
FIG. 1A is a cross-sectional view of the hair extension, taken along line 1A—1A of FIG. 1.

FIG. 1 is a perspective view of a hair extension 10 of the present invention in use. FIG. 1A is a cross-sectional view of the hair extension 10, taken along line 1A—1A of FIG. 1.

Referring to FIGS. 1 and 1A, the hair extension 10 comprises hair strands 12 affixed to a ring assembly 14.

Figure 1B:
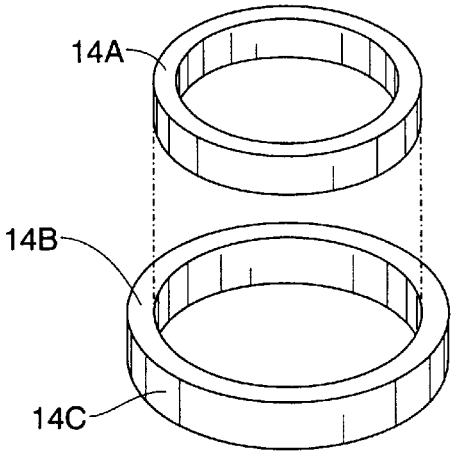
FIG. 1B is an exploded perspective view of the ring assembly.

FIG. 1B is an exploded perspective view of the ring assembly 14. Referring to FIGS. 1A and 1B, the ring assembly 14 comprises an inner ring 14A and an outer ring 14B. The inner ring 14A is configured to nest within the outer ring 14B, with distal ends of the hair strands 12 impinged between the inner and outer rings 14A, 14B. The hair strands 12 are turned about the outer ring 14B to cover an outer surface 14C of the outer ring 14B.

Figure 2:
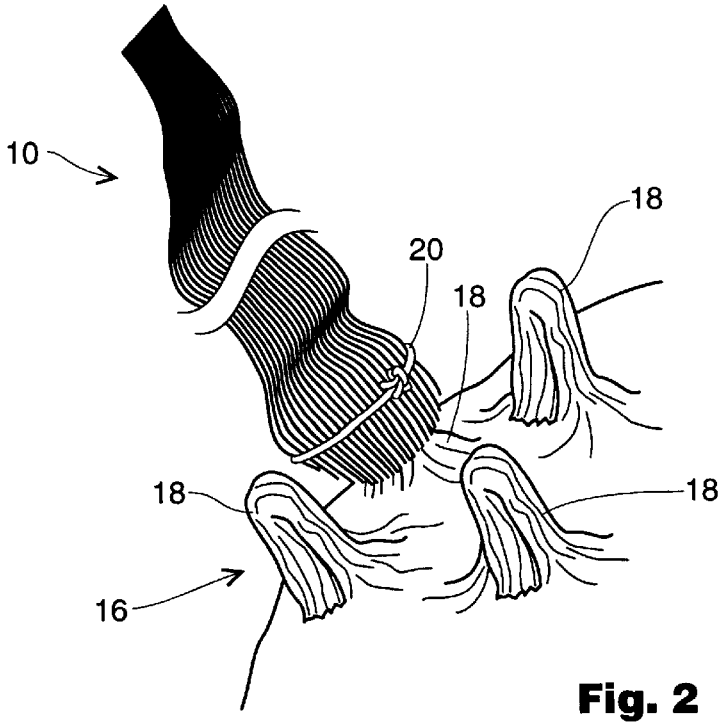
FIG. 2 is a perspective view showing a method of attaching the hair extension to the hair plait.

Referring back to FIG. 1, to use the invention, a user's hair 16 is first parted and plaited to form plaits 18. The plait 18 is then inserted through the ring assembly 14 of the hair extension 10. FIG. 2 is a perspective view showing one method of affixing the hair extension 10 to the hair plait 18. A band 20 is tied about the hair extension 10 above the ring assembly 14.

Figure 3:
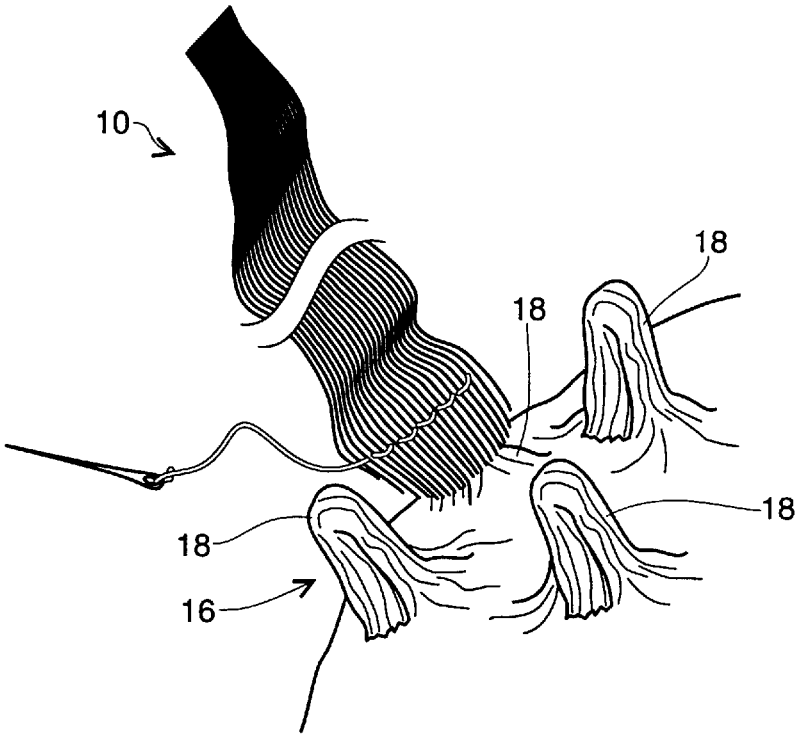
FIG. 3 is a perspective view of another method of attaching the hair extension to the hair plait.

FIG. 3 is a perspective view showing another method of affixing the hair extension 10 to the hair plait 18. The hair extension 10 is sewn to the plait 18.

Figure 4:
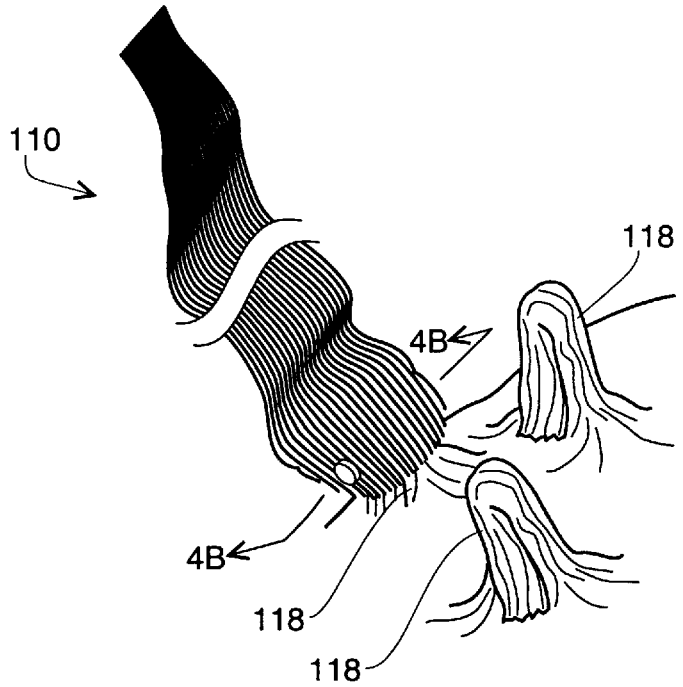
FIG. 4 is a perspective view of another embodiment of the hair extension, attached to a hair plait.
Figure 4A:
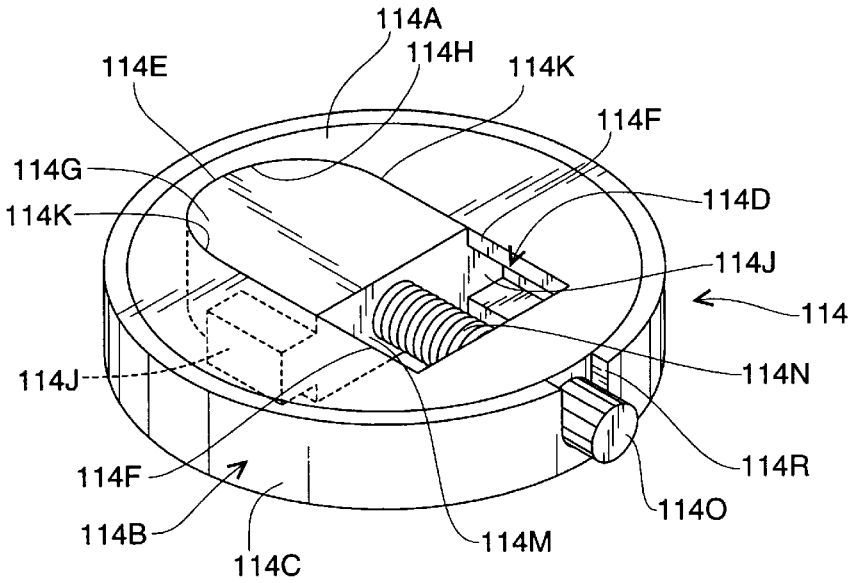
FIG. 4A is a perspective view of the ring assembly of the embodiment of FIG. 4.
Figure 4B:
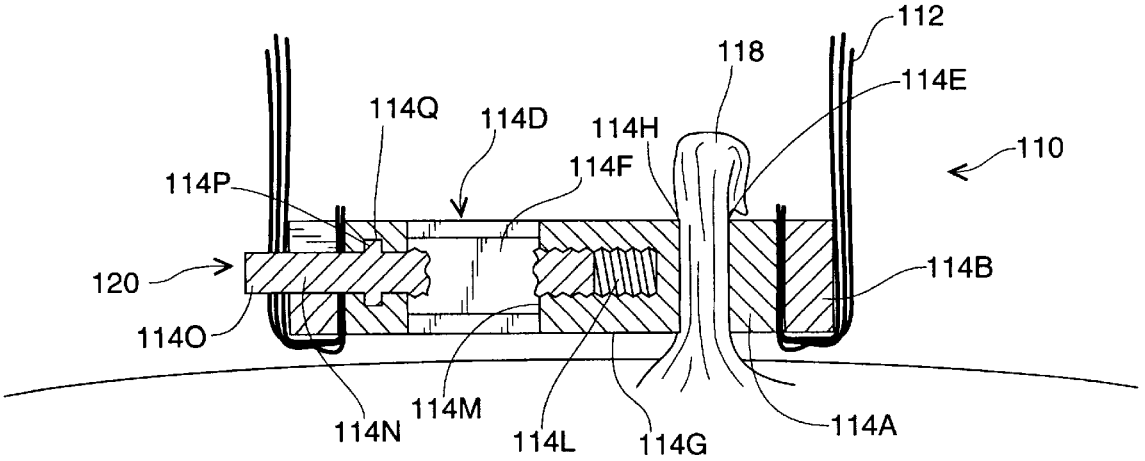
FIG. 4B is a cross-sectional view of the ring assembly taken along line 4B—4B of FIG. 4.

FIG. 4 is a perspective view of another embodiment of the hair extension 110, attached to a hair plait 118. FIG. 4A is a perspective view of a ring assembly 114 of the embodiment of FIG. 4. FIG. 4B is a cross-sectional view of the ring assembly 114 taken along line 4B—4B of FIG. 4. Referring to FIGS. 4–4B, the ring assembly 114 comprises an inner ring member 114A and an outer ring 114B. The inner ring member 114A is configured to nest within the outer ring 114B, with distal ends of the hair strands 112 impinged between the inner ring member 114A and the outer ring 114B. The hair strands 112 are turned about the outer ring 1141B to cover an outer surface 114C of the outer ring 114B.

The inner ring member 114A includes a aperture 114D therein, which has a rounded distal end 114E. The aperture 114D is bounded by straight slotted sides 114F. An urging member 114G is configured to ride within the aperture 114D. A distal end 114H of the urging member 114G is rounded to conform to the distal end 114E of the aperture 114D. The urging member 114G is maintained within the aperture 114D by elongated ears 114J which depend outwardly from opposing sides 114K of the urging member 114G and ride within the slotted sides 114F.

The urging member 114G includes a threaded sleeve 114L which penetrates a proximal end 114M of the urging member 114G. An elongated rotatable member 114N is configured to threadingly travel within the sleeve 114L. In FIG. 4B, a portion of the rotatable member 114N is broken away to show one of the slotted sides 114F.

The rotatable member 114N extends through the inner ring member 114A and terminates with a knurled head 114O outside of the inner ring member 114A. The rotatable member 114N is free to rotate with respect to the inner ring member 114A and the urging member 114G, but the rotatable member 114N is restricted from translational movement with respect to the inner ring member 114A and the urging member 114G. This restriction is accomplished by an annular ridge 114P which depends outwardly from the rotatable member and is captured within an annular slot 114Q within the inner ring member 114A.

The outer ring 114B has a generally unshaped opening 114R which accommodates the rotatable member 114N, permitting the outer ring 114B to slide over the inner ring member 114A.

Referring now particularly to FIG. 4B, the ring assembly 114 is attached to the plait 118 by initially turning the rotatable member 114N to translate the urging member 114G away from the distal end 114E of the aperture 114D. The plait 118 is then inserted between the urging member 114G and the distal end 114E of the aperture 114D. The rotatable member 114N is then turned to translate the urging member 114G toward the distal end 114E of the aperture 114D, thus urging against he plait 118 and capturing the plait 118 within the ring assembly 114.

The hair extensions 10, 110 shown are straight in style, but may be of other styles, such as braided. It is not necessary to plait the user's hair 16 before using the straight style of the hair extension 10, 110. The user's unplaited hair 16 may be pulled through the ring assembly 14, 114 and through the center of the hair extension 10, 110, sliding the ring assembly 14, 114 to the base of the hair 16. The hair 16 and the hair strands 12, 112 are then combed to blend together.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A hair extension comprising:

a. a ring assembly comprising an inner ring and an outer ring;

b. a plurality of hair strands;

c. distal ends of the hair strands captured between the inner ring and the outer ring; and d. the hair strands turned about the outer ring to cover an outer surface of the outer ring.

2. A hair extension comprising:

a. a ring assembly comprising an inner ring member and an outer ring;

b. a plurality of hair strands wherein the distal ends of the hair strands captured between the inner ring member and the outer ring;

c. the hair strands turned about the outer ring to cover an outer surface of the outer ring;

d. an aperture disposed within the inner ring;

e. an urging member slidably disposed within the aperture;

f. a rotatable member attached to the urging member and configured to slide the urging member along the aperture when the rotatable member is rotated with respect to the inner ring member;

g. whereby a plait of human hair is captured within the inner ring by inserting the plait into the aperture between the urging member and an end of the aperture, and then rotating the rotating member to urge the urging member against the plait, thus capturing the plait between the urging member and the end of the aperture.

* * * * *